United States Patent [19]

Harned et al.

[11] 4,306,589

[45] Dec. 22, 1981

[54] LOW POWER SOLENOID-OPERATED AIR VALVE WITH MAGNETIC LATCHING

[75] Inventors: Timothy J. Harned, Durham, N.H.; Wilbert G. Kautz, Bryan, Ohio; Charles K. Taft, Durham, N.H.

[73] Assignee: The Aro Corporation, Bryan, Ohio

[21] Appl. No.: 110,649

[22] Filed: Jan. 9, 1980

[51] Int. Cl.[3] ..... F15B 13/044

[52] U.S. Cl. ..... 137/625.65; 137/625.5; 251/65; 251/141

[58] Field of Search ..... 137/625.5, 625.65; 251/65, 139, 141

[56] References Cited

U.S. PATENT DOCUMENTS 3,203,447 8/1965 Bremner ..... 137/625.65 X 3,809,123 5/1974 Heimann ..... 137/625.5

OTHER PUBLICATIONS

IBM Technical Disclosure Bulletin, vol. 20, No. 3, Aug. 1977.

*Primary Examiner*—Gerald A. Michalsky

*Attorney, Agent, or Firm*—Allegretti, Newitt, Witcoff & McAndrews

[57] ABSTRACT

An electromagnetically controlled pneumatic valve includes a chamber having a first nozzle of magnetic material in opposed relation to a second nonmagnetic nozzle. A cylindrical, permanent magnet, valve member may become seated upon one or the other of the nozzles in response to an electromagnetic field generated by a coil surrounding the first nozzle. A conduit from the chamber between the nozzles connects to a pneumatic load such as an air tool.

8 Claims, 10 Drawing Figures

Fig. 1
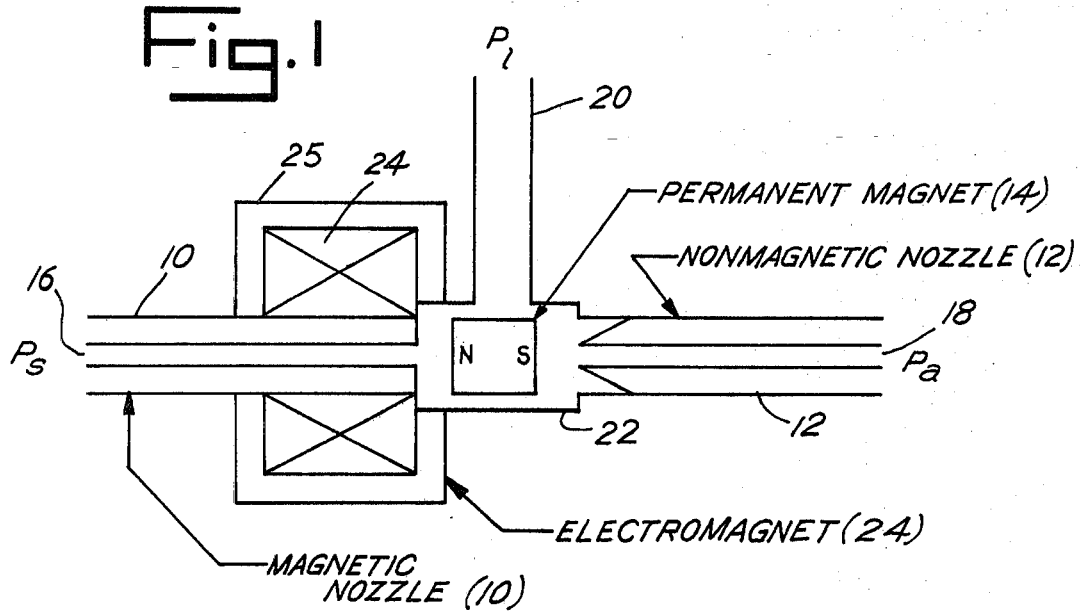
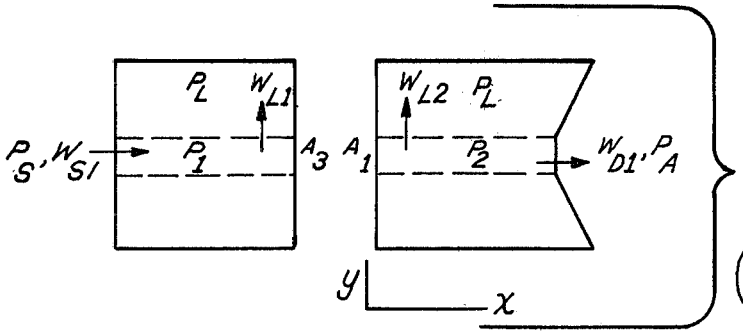
Fig. 2
(CONTROL VOLUME)
Fig. 3
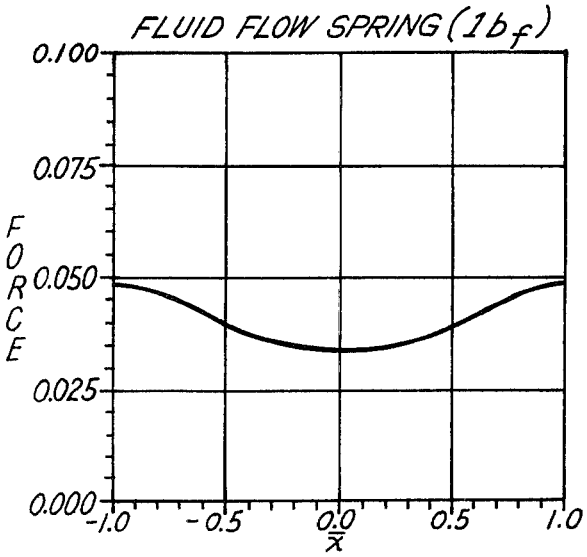
Fig. 4
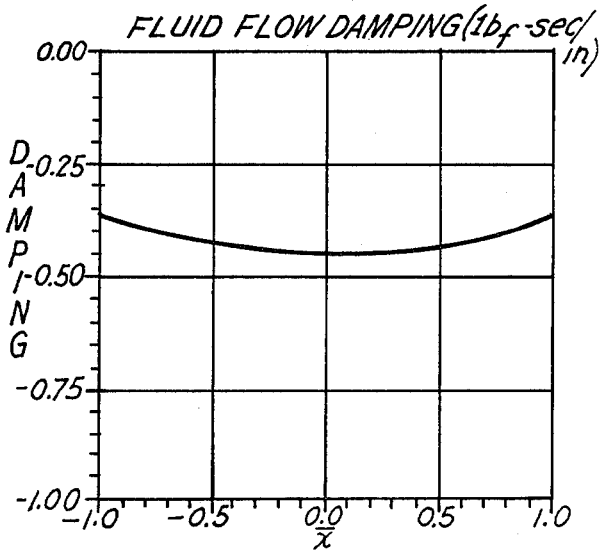

GAUSS-OERSTED CURVE FOR THE PERMANENT MAGNETS

ELECTRO-PERMANENT MAGNET CONFIGURATION

ANALY. & EXP. MAGNETIC FORCE ($lb_f$) VS. DISP. CURVES

LOW POWER SOLENOID-OPERATED AIR VALVE WITH MAGNETIC LATCHING

BACKGROUND OF THE INVENTION

This invention relates to an improved electromagnetically controlled fluid valve. Pneumatic systems offer the possibility of high power, fast performance and economical control. At the same time, semi-conductor developments have made complex electrical signal processing available at a very low cost. To apply the benefits of electrical signal processing, and, in particular, digital signal processing to pneumatic systems, interface transducers between the electrical signals and pneumatic switches are needed. In addition to providing this interface, it would be desirable to develop a device that would not only be inexpensive to manufacture but also have very low electrical power consumption. This would enable the interface to obtain its electrical power from the same source as the semi-conductor logic.

Heretofore, Bremner et al in U.S. Pat. No. 3,203,447 issued Aug. 31, 1965 for a Magnetically Operated Valve, described a device which interfaced electrical signals and with a pneumatic valve. The Bremner et al patent teaches that a magnetically polarized valve member may be switched or shuttled between valve seats by means of an electromagnetic coil which controls the magnetic field. Switching of the valve is dependent upon the summation of magnetic flux fields of a permanent magnet and an electromagnet.

While such a magnetically operated valve appears to be operable, an improved valve has been sought which much more efficiently charges the permanent magnet force and thereby will quickly switch in response to short term, low power electromagnetic signals. It is this motivation which led to the following described electromagnetic fluid valve.

SUMMARY OF THE INVENTION

Briefly, the present invention comprises a pair of opposed, spaced nozzles defining valve seats. A permanent magnet, valve member is positioned between the nozzles. One of the nozzles is made of a ferromagnetic material. The other nozzle is nonmagnetic. A pneumatic or fluid load is connected to a chamber between the nozzles. An electric coil surrounds the ferromagnetic nozzle and controls the position of the valve member in response to coil activation.

Thus, it is an object of the invention to provide an improved electromagnetic fluid valve.

It is a further object of the invention to provide an electromagnetic fluid valve with fast response times and which operates in response to low power inputs to switch the valve.

A further object of the invention is to provide an economical electromagnetically controlled pneumatic valve.

An additional object of this invention is to provide a valve that consumes zero steady state electrical or pneumatic power.

These and other objects, advantages and features of the invention will be set forth in the detailed description which follows.

BRIEF DESCRIPTION OF THE DRAWING

In the detailed description which follows, reference will be made to the drawing comprised of the following figures:

FIG. 1 is a schematic view of the valve of the present invention;

FIG. 2 is a schematic representation of the fluid control volume around the member;

FIGS. 3 and 4 are graphs of the fluid flow characteristics of the valve;

DESCRIPTION OF THE PREFERRED EMBODIMENT

Physical Description

Figure 6:
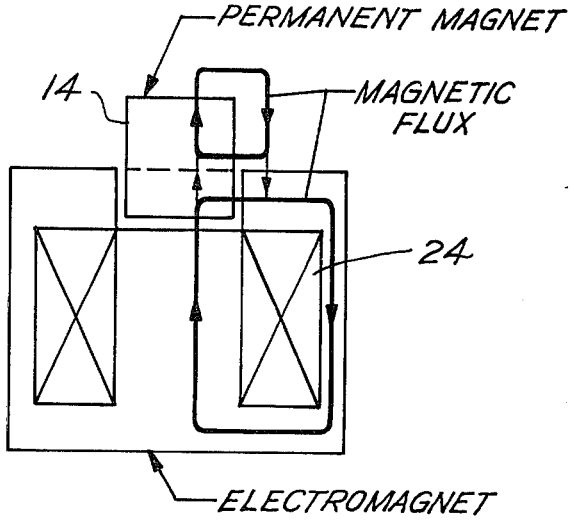
FIG. 6 is a schematic view of the magnetic flux paths for the valve.

FIG. 1 is a schematic view of the valve of the invention. A pair of nozzles 10, 12 are aligned axially in opposed, spaced relation. A cylindrical, permanent magnet 14, magnetized axially as discussed below with respect to FIG. 6 is positioned between the nozzles 10, 12. One of the nozzles 10 is constructed of a ferromagnetic material and is connected to a fluid supply 16. The other nozzle 12 is made from a nonmagnetic material, and it is connected to exhaust 18. A load such as an air tool (not shown) is connected by a passage 20 to the center region or chamber 22 between the nozzles and thus encloses around the permanent magnet valve member 14. The chamber 22 defines walls which facilitate guiding of magnet 14 between nozzles 10, 12. An electromagnetic coil 24 surrounds the nozzle 10 with the axis of coil 24 coincident with the axis of nozzle 10. The nozzle 10 serves as a field piece for the coil 24. Additional field piece 25 surrounds the coil 24.

The valve operates as follows: When the permanent magnet valve member 14 is against the left nozzle 10, the member 14 is able to latch itself to that ferromagnetic nozzle 10. This latching effectively shuts the nozzle 10 off and prohibits fluid supply flow from reaching the load through passage 20. At the same time whatever fluid is at the load is able to escape through the passage 20, chamber 22 and other nozzle 12 out to exhaust 18. If the coil 24 is properly energized, it is possible to repell the permanent magnet member 14 from ferromagnetic nozzle 10 toward the nonmagnetic nozzle 12. The pressure area force created by the fluid flow will keep the permanent magnet member 14 latched to the non-magnetic nozzle 12 after the coil 24 is deenergized. Thus, once the switching is completed, the electromagnetic coil 24 is deenergized.

With the permanent magnet 14 in position on the exhaust nozzle 12, supply flow is allowed to reach to the load through chamber 22 and passage 20. If the coil 24 is again energized, but with the opposite polarity, the permanent magnet member 14 can be attracted from the non-magnetic nozzle 12 back to the ferromagnetic nozzle 10. The permanent magnet member 14 then magnetically latches itself to nozzle 10 and the coil 24 may be deenergized. Again, fluid flow is directed as it was when the permanent magnet member 14 was previously in this position.

A major advantage of this design is that no electrical or fluid power is consumed during steady state operation. Only during switching of the permanent magnet valve member 14 is power consumed.

The functional design of the valve and the optimization of that design, with respect to power consumption and physical dimensions, depends upon two things: the force exerted on the permanent magnet 14 by the fluid flow and the force exerted by the electromagnet 24. The fluid flow force is a function of the physical dimensions of the valve and the supply pressure. The magnetic force depends upon the size, shape and material of the electromagnet 24 and permanent magnet 14. The magnetic flux path between the permanent magnet 14 and the electromagnet 24 is also an important factor.

Theoretical Analysis

In the following theoretical analysis of the operation and dimensions of the valve, the glossary of terms is as follows:

| | |
|---|---|
| A | = Cross Sectional Area of the air gap ($cm^2$) |
| $A_{cv}$ | = Control Volume Area ($m^2$) |
| $A_1$ | = Magnetic nozzle Area ($m^2$) |
| $A_2$ | = Non Magnetic nozzle Area ($m^2$) |
| $A_m$ | = Permanent magnet cross-sectional Area ($m^2$) |
| B | = Gauss (flux/$cm^2$) |
| $\bar{B}$ | = Dimensionless Damping |
| $B_e$ | = fluid damping (Nsec/m) |
| $C_d$ | = flow discharge coeff |
| $d_1$ | = Magnetic nozzle dia (m) |
| $d_2$ | = Non Magnetic nozzle dia (m) |
| $F_m$ | = magnetic forces (N) |
| $F_x$ | = Fluid force on the permanent magnet (N) |
| H | = Oersteds (mmf/cm) |
| I | = coil current (ampere) |
| K | = fluid spring (N/m) |
| L | = length of the air gap (cm) |
| $L_a$ | = Control Volume Length (m) |
| $L_b$ | = Control Volume Length (m) |
| mmf | = magnetic motive force |
| N | = Number of turns of wire in a coil |
| $\hat{n}$ | = normal Vector |
| P | = Permeance |
| $P_a$ | = drain pressure (P) |
| $P_L$ | = load pressure (P) |
| $P_s$ | = supply Pressure (P) |
| $\bar{P}_a$ | = $P_a/P_s$ |
| $\bar{P}_L$ | = $P_L/P_s$ |
| R | = Universal Gas constant |
| S | = ½ the permanent magnet surface area |
| T | = Temperature (R) |
| t | = time |
| u | = Permanent magnet underlap (m) |
| V | = mass Velocity (m/sec) |
| $\bar{V}$ | = Velocity Vector |
| $\forall$ | = Volume ($m^3$) |
| W | = mass flow ($m^3$/sec) |
| X | = displacement of permanent magnet (m) |
| $\bar{X}$ | = x/u |
| $\rho$ | = density of air (Kg/$m^3$) |
| $\mu$ | = permeability of a material |
| $\tau$ | = dimensionless time |
| $\phi$ | = flux |

The flow force on the permanent magnet can be predicted using the momentum equation applied to the control volumes encompassing the fluid on either side of the permanent magnet in the x direction (see FIG. 2).

The forces on control volumes including the force F, exerted by the permanent magnet are:

$$F = \oint_s P \cdot \hat{n}\, dA_{cv} + \frac{\partial}{\partial t} \oint_v \rho \bar{V}\, d\forall + \oint_s \rho \bar{V}(\bar{V} \cdot \hat{n})\, d A_{cv}$$

This vector equation can be rewritten for the force components in the direction of the permanent magnet motion:

$$F_x = (P_s A_1) - (P_a A_2) + P_L((A_m - A_1) - (A_m - A_2)) + \frac{\partial}{\partial t}[-LaWs_1 - LbWd_1] + [-Ws_1 Vs_1 + Wd_1 Vd_1]$$

Using the compresible flow equations for sharp edged orifice from Anderson, THE ANALYSIS AND DESIGN OF PNEUMATIC SYSTEMS, p. 32, the following calculation can be made:

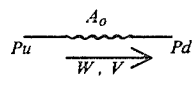

$$W = \frac{C_d A_o}{\sqrt{RT}} \sqrt{Pu^2 - Pd^2}\ ,\ V = \sqrt{\frac{RT}{Pd}} \sqrt{Pu^2 - Pd^2}$$

where

W = the mass flow rate

V = the mass velocity

Therefore, the system equations become:

$$Ws_1 = \frac{C_d \pi d_1 (u + x)}{\sqrt{RT}} \sqrt{P_s^2 - P_L^2}\quad Vs_1 = \sqrt{\left[\left(\frac{P_s}{P_L}\right)^2 - 1\right] RT}$$

$$Wd_1 = \frac{C_d \pi d_2 (u - x)}{\sqrt{RT}} \sqrt{P_L^2 - P_a^2}\quad Vd_1 = \sqrt{\left[\left(\frac{P_L}{P_a}\right)^2 - 1\right] RT}$$

Neglecting the time rate of change of pressure terms which are usually small for pneumatic systems the Force equation becomes:

$$F_x = (P_s A_1) - (P_a A_2) + P_L((A_m - A_1) - (A_m - A_2)) + \frac{C_d \pi}{\sqrt{RT}}\left[-d_1 L_a \sqrt{P_s^2 - P_L^2} + d_2 L_b \sqrt{P_L^2 - P_a^2}\right]\dot{x} + C_d\left[-A_1\left[\frac{P_s^2 - P_L^2}{P_L}\right] + A_2\left[\frac{P_L^2 - P_a^2}{P_a}\right]\right]$$

The algebraic expression for $F_x$ is still in terms of $P_L$ which is an undetermined quantity. Neglecting the compressability effects and with no flow to the load $Ws_1 = W_{L1} = W_{L2} = Wd_1$. A relationship between the unknown pressure and permanent magnet displacement in terms of the physical dimensions of the valve and supply pressure can be developed. For the system constructed the force versus displacement plot is shown in FIG. 3.

In a similar way, the coefficients of the permanent magnet's velocity in the force equation can be evaluated to obtain flow induced damping coefficient. The flow damping versus displacement plot is shown in FIG. 4.

If the flux paths for a magnetic configuration are known, it is possible to develop a lumped parameter model for the magnetic circuit. Every magnetic device, either an electromagnet or a permanent magnet, has associated with it three properties. A magnetic motive force (mmf) that causes a flux ($\phi$) to travel through a magnetic resistance (R). The mmf, flux and resistance in the magnetic circuit are analogous to the voltage current and resistance of an electrical circuit. In the magnetic circuit, the flux travels in a closed path through the magnetic material and air gaps. Each path has a resistance; the resistance of this path varies according to the material in the path.

In many cases, a magnetic circuit is discussed in terms of permeance (P) rather than resistance (R) where $P=1/R$. For a magnet without a well defined ferromagnetic flux path; i.e.: an open circuit magnet, the permeance is defined in terms of the surface area:

$$P = 1.77\sqrt{s}$$

where $s=\frac{1}{2}$ the exposed surface area of the magnet

For a magnet that does have a defined ferromagnetic flux path, the permeance is determined by the length, area and material in that flux path:

$$P=\mu A/L$$

$\mu$=permeability of the material

A=cross-sectional area of the material

L=length of the material

If a magnetic circuit has more than one material in the flux path, the permeance for the individual materials must be calculated then added together to determine the permeance for the entire circuit.

Figure 5:
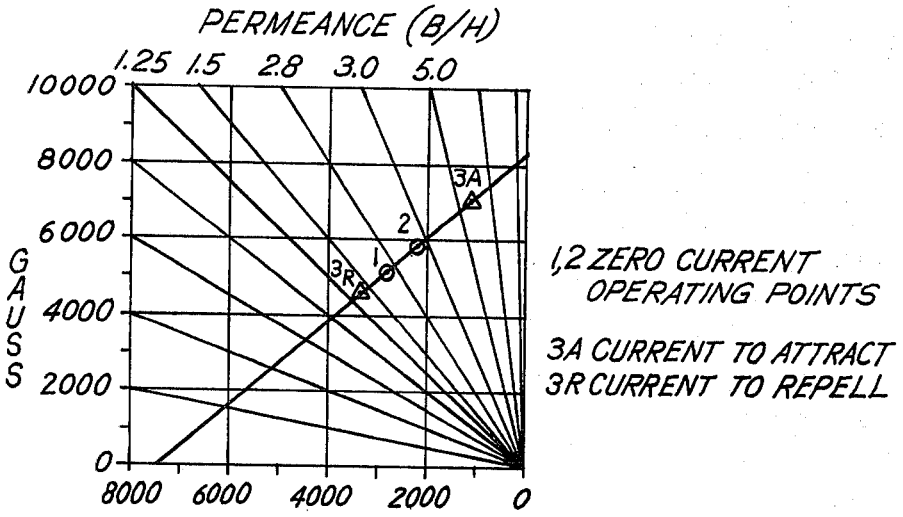
FIG. 5 is a graph of the permanent magnet characteristics of the valve.

The permeability is also defined as the slope ($-B/H$) of a line in the B-H curve for a given magnetic material. (See FIG. 5.)

For the electromagnet permanent magnet configuration shown in FIG. 6, it is possible to calculate the magnet forces acting on the permanent magnet. The permanent magnet is modeled by dividing it into two lumped magnets at the point it enters the electromagnet. It is then possible to think of the permanent magnet as being made up of two smaller permanent magnets, each with a different flux path. The permeance of the two smaller permanent magnets can be calculated using the already discussed methods.

Once the permeances have been determined, they are plotted on the B-H curve for that permanent magnet. The point where the permeance intersects the B-H curve is the operating point for that permanent magnet (see points 1 and 2 in FIG. 5). By moving from this operating point to the vertical axis, the flux density (gauss) for each of the permanent magnets can be determined. The difference of the flux densities at the opposite ends of the two permanent magnets can be related to the force on the magnet that they represent by the following equation:

$$F = \frac{(B_1^2 - B_2^2)\,AM}{8\pi}$$

where

F=Force (dynes)

B=Flux density (lines or flux per sq.cm.)

1: Permanent magnet section in the electromagnet

2: Permanent magnet section out of electromagnet

Am=Cross-sectional area of the magnet ($cm^2$)

All discussion thus far has been for the case where the electromagnet is deenergized. When the electromagnet is energized, it changes the flux density at the end of the permanent magnet that is closest to the electromagnet. Whether the flux density is increased or decreased depends upon the polarity of the voltage applied to the electromagnet. By dividing the horizontal scale (oersteds) of the B-H curve by the permanent magnet length, the scale is now in terms of Gilberts. The effect of the electromagnet on the permanent magnet can be calculated using the following expression:

$$mmf=NI\,\pi 4/10$$

where mmf=magnetic motive force (Gilberts)

N=number of turns of wire in the coil

I=current in the coil windings (amps)

The original (zero electromagnet current) operating point of the permanent magnet located within the electromagnet, has associated with it a fixed flux density and a magnetic motive force. If the electromagnet is energized to attract the permanent magnet, the permanent magnet's mmf is increased by $NI4\pi/10$ gilberts. Likewise, if the electromagnet is energized to repel the permanent magnet, the permanent magnet's mmf is decreased by $NI4\pi/10$ gilberts.

The change in mmf for the permanent magnet creates a new operating point on the B-H curve and, therefore, a new flux density for the permanent magnet. (See points 3A and 3R in FIG. 5.) It should be noted that the flux density of the permanent magnet lump outside the electromagnet ($B_2$) does not change regardless of what happens to the electromagnet; only the flux density of the permanent magnet lump inside the electromagnet ($B_1$) changes. If $B_1$ is increased, then the force on the permanent magnet increases; if $B_1$ is decreased, then the force on the permanent magnet decreases. If $B_1$ is decreased to the point where it is less then $B_2$, the force on the permanent magnet becomes negative. This is the point where the electromagnet will no longer attract the permanent magnet, but rather, it will repel it.

Figure 7:
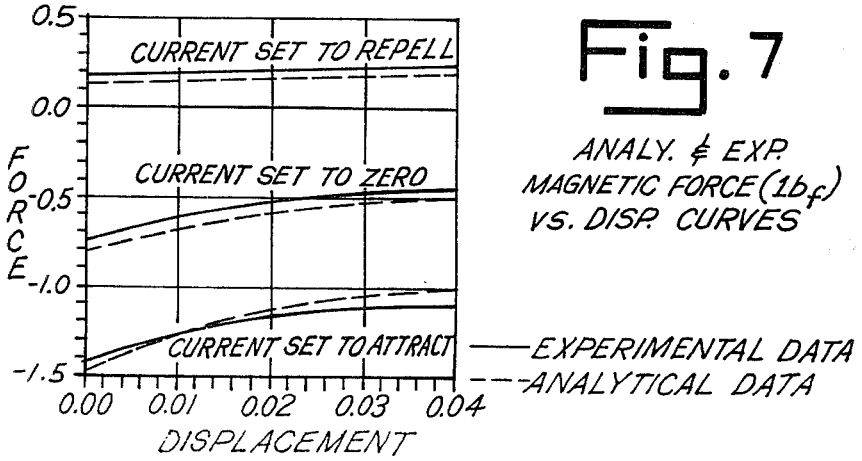
FIGS. 7–9 are graphs of additional magnetic characteristics of the valve.

Using a Celesco force transducer and potentiometer the magnetic force versus displacement curves are plotted. FIG. 7 shows the calculated and experimental force versus displacement curve with the electromagnet in its various modes of operation. The top curve is with the electromagnet 24 energized to repel the permanent magnet 14. The middle curve is the electromagnet 24 turned off, and the third curve is with the electromagnet energized to attract the permanent magnet 14.

System Optimization and Control

Knowing the fluid flow and magnet forces of the switching element, it becomes possible to optimize the valve design. Two strategies are followed in this optimization. When the permanent magnet 14 is against the electromagnet nozzle 10, it has to be able to latch itself to the electromagnet nozzle 10. This latching force has to overcome the pressure area force developed by the fluid at supply pressure within the nozzle 10. In addition to the fluid force, the latching force must also be able to withstand disturbances to the system.

When the permanent magnet 14 is against the non-magnetic nozzle 12 it is the pressure area force that performs the latching. Because of the air gap between the permanent magnet 14 and the ferromagnetic nozzle 10, the magnetic forces are reduced. This enables the fluid force to perform the latching. The larger the air gap is made, the weaker the magnetic forces become. The effect of this is to increase the latching force. If the air gap is made too large, then it becomes difficult for the electromagnet 24 to attract the permanent magnet 14 back to the ferromagnetic nozzle 10. Therefore, following this rational, it is possible to determine the optimum air gap.

Figure 8:
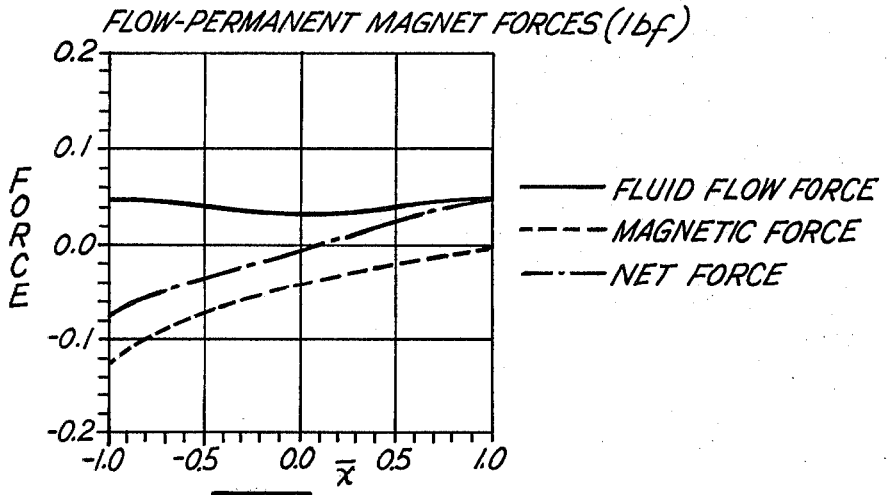
Figure 9:
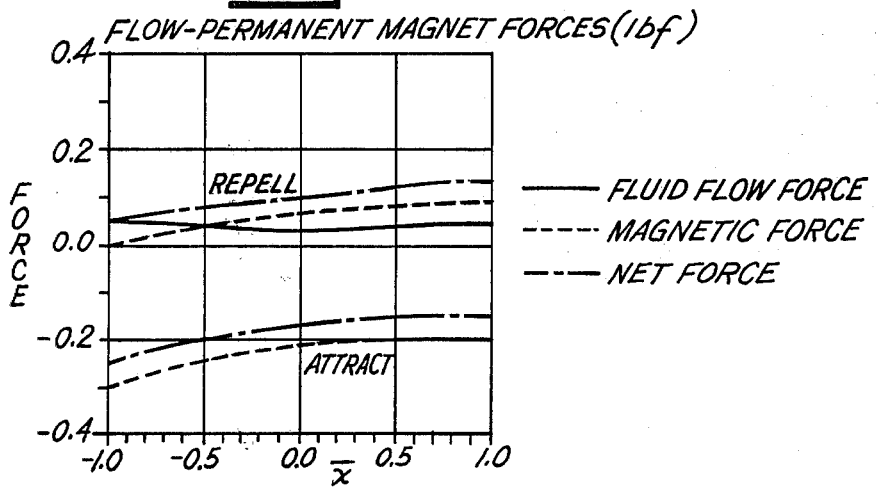

By plotting the sum of the fluid flow force and the magnetic force, the optimum air gap and ampereturns for the electromagnets 24 can be determined. (See FIGS. 8 and 9.)

Because the switching process is a transient situation, a dynamic analysis must be conducted to determine the switching time. A differential equation for the motion of the permanent magnet 14 can be written as:

$$m\ddot{x}=B_e(\dot{x})+K(x)=\pm Fm$$

where m=mass $B_e(\dot{x})$=flow damping forces

K(x)=Flow spring forces $F_m$=magnet forces (direction dependent on an applied voltage)

By letting:

$d/d\tau$=the derivative with respect to time and x/u =$\bar{x}$ to make the displacement dimensionless The system equation becomes:

$$\frac{d^2-x}{d\tau^2}=\pm\frac{Fm}{m}-\frac{B_e}{m}\frac{d\bar{x}}{d\tau}-\frac{k}{m}\bar{x}$$

Figure 10:
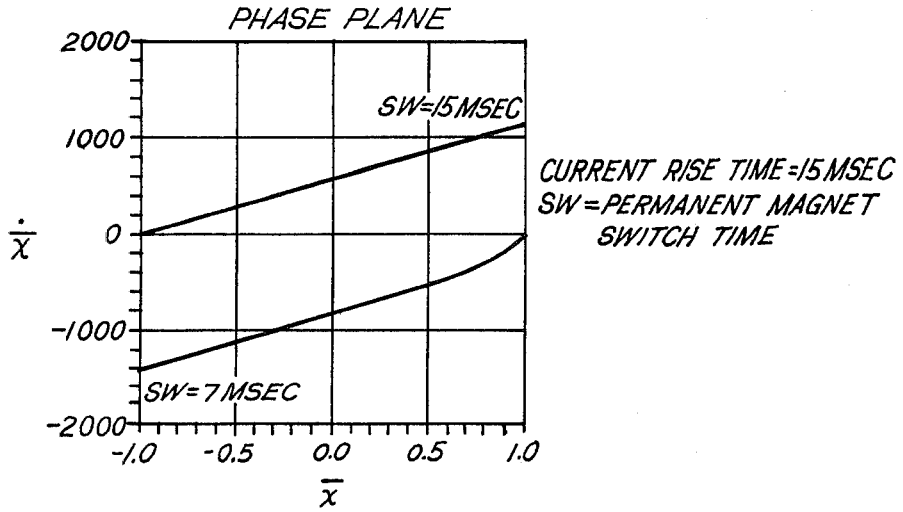
FIG. 10 is a phase plane plot of the moving member from which the switch times can be determined.

The phase plane solutions to this equation are shown in FIG. 10. In order to determine the permanent magnet switching time the initial conditions of interest are $\bar{x}=\pm 1$ and $\bar{\dot{x}}=0$. These are the initial conditions when the permanent magnet is latched to the nozzles. The inductive rise time of the winding was incorporated into the computer simulation that generated the phase plane portrait. This causes the solution of this equation to be valid for only one inductive rise time.

The different trajectories represent the two different initial conditions ($\bar{x}=\pm 1$). The trajectory with positive velocity represents the permanent magnet moving toward the non-magnetic nozzle. The other trajectory represents motion in the other direction. The tic marks on the trajectories represent equal units of time and it is therefore possible to determine the switching period of the permanent magnet. The longer the current remains on the velocity the permanent magnet obtains and the shorter the switch time is. It should be noted that increasing the permanent magnets switching velocity will increase the damage or wear on the nozzles and permanent magnet because of the increase of kinetic energy dissipated upon impact.

In summary, the ability of an electromagnet to repel a permanent magnet is used to provide forces for electropneumatic valve operation. An electromagnet can be used to attract the moving valve element or the electromagnet can be used to repel it. In addition, the permanent magnet valve member 14 will, by virtue of its residual magnetism, cling to the nozzle 10 which it is closing, even after the electromagnet 24 is deenergized. This provides for valve operation with no standby electromagnet current. This design always returns to the "off" position when $P_s$ is reduced to $P_a$. It is also possible to construct the device such that there is no standby pneumatic power consumed in the first stage. Mathematical models for the pneumatic flow forces and the magnetic forces on the valving element enable the design to be optimized.

Although various alternative structures embodying the invention are therefore possible, the invention is limited only by the following claims and their equivalents.

What is claimed is:

1. An improved eletromagnetically controlled fluid valve comprising, in combination:

a first fluid nozzle of magnetizable material defining a first valve seat;

a second fluid nozzle of non-magnetic material defining a second valve seat in opposed relation to the first seat and spaced from the first seat;

a valve member of permanently magnetized material mounted for translation between the seats, said valve member having one pole in opposed relation respectively to each of said seats and being translatable between the seats to alternatively seal the respective nozzles;

electromagnet means at said first nozzle;

means for energizing the electromagnet means and controlling the magnetic field in the region between the nozzles whereby momentary energization of the electromagnet means will cause translation of the valve member from one to the other of the nozzles; and said valve member being returnable to seat on the first nozzle when fluid input and electric input to the valve and electromagnet means are both removed.

2. The valve of claim 1 including a fluid chamber defined between the valve seats with a passage from the chamber for connection to a fluid load, said first fluid nozzle defining an inlet to the chamber, said second fluid nozzle defining an exhaust from the chamber.

3. The valve of claim 1 wherein the electromagnet means comprises a coil and said first nozzle comprises a ferromagnetic tube through the coil defining, in part, a field piece for the coil.

4. The valve of claim 3 including additional field piece means surrounding the coil.

5. The valve member of claim 1 wherein the electromagnetic means, upon activation, serves to repel the valve member from the first nozzle to a seat on the second nozzle upon reaching a threshold density of magnet flux.

6. The valve member of claim 1 wherein the first nozzle is a fluid inlet nozzle.

7. The valve member of claim 1 wherein the first nozzle is a fluid inlet nozzle and the second nozzle is an exhaust nozzle.

8. The valve member of claim 1 wherein the valve member is magnetized axially with respect to the direction of valve member travel between the valve seats.

* * * * *